US006076987A

United States Patent [19]

Sekine et al.

[11] Patent Number: 6,076,987

[45] Date of Patent: Jun. 20, 2000

[54] BALLPOINT PEN AND CAP THEREFOR

[75] Inventors: Nobuo Sekine; Takehiko Yokosuka; Masashi Andoh; Yoshiaki Okawara, all of Aichi, Japan

[73] Assignee: The Pilot Ink Co., Ltd., Aichi, Japan

[21] Appl. No.: 08/362,167

[22] Filed: Dec. 22, 1994

[30] Foreign Application Priority Data

| | | | |
|---|---|---|---|
| Dec. 22, 1993 | [JP] | Japan | 5-073445 |
| Dec. 22, 1993 | [JP] | Japan | 5-073446 |
| Jun. 6, 1994 | [JP] | Japan | 6-148456 |

[51] Int. Cl.[7] ..... B43K 7/00

[52] U.S. Cl. ..... 401/209; 401/216

[58] Field of Search ..... 401/209, 216

[56] References Cited

U.S. PATENT DOCUMENTS

| | | | |
|---|---|---|---|
| 3,418,057 | 12/1968 | Shea | 401/209 |
| 4,139,313 | 2/1979 | Hori | 401/216 |
| 4,251,164 | 2/1981 | Nakagawa et al. . | |
| 4,311,403 | 1/1982 | Liguori | 401/209 |
| 4,457,644 | 7/1984 | Yokosuka . | |
| 4,842,433 | 6/1989 | Otsuka | 401/216 X |

FOREIGN PATENT DOCUMENTS

| | | | |
|---|---|---|---|
| 91516 | 10/1983 | European Pat. Off. | 401/209 |
| 998671 | 10/1949 | France . | |
| 1019355 | 10/1952 | France . | |
| 142017 | 6/1980 | Germany | 401/209 |
| 3430602 | 3/1985 | Germany | 401/209 |
| 62-5978 | 1/1987 | Japan . | |
| 25994 | 2/1990 | Japan . | |
| 306666 | 10/1952 | Switzerland . | |
| 2073676 | 10/1981 | United Kingdom | 401/209 |
| 2114065 | 8/1983 | United Kingdom | 401/209 |

*Primary Examiner*—David J. Walczak

*Attorney, Agent, or Firm*—Sughrue, Mion, Zinn, Macpeak & Seas, PLLC

[57] ABSTRACT

The present invention provides the ballpoint pen that precludes the possibility of the pipe portion bending at the joint thereof can be provided even if the outer diameter D is small. In the ballpoint pen having a ballpoint pen tip at a front end thereof, the ballpoint pen tip rotatably accommodating a ball at a front end of a pipe made of metal, an outwardly projecting pipe portion having a uniform thickness throughout the length thereof is arranged at a front end of the ballpoint pen tip, and if a length of the pipe portion is L, an outer diameter of the pipe portion is D, a relational expression "L/D≦4.0" is satisfied.

38 Claims, 9 Drawing Sheets

BALLPOINT PEN AND CAP THEREFOR

BACKGROUND OF THE INVENTION

1. Field of the Invention

The present invention relates to ballpoint pens. More specifically, the present invention is directed to a so-called pipe type ballpoint pen having a ballpoint pen tip at the front end thereof, the ballpoint pen tip rotatably accommodating a ball at the front end of a pipe made of metal. The invention is particularly related to a pipe type ballpoint pen adapted for writing thin characters.

2. Description of the Related Art

A well known conventional ballpoint pen is so designed that a ballpoint pen tip which rotatably accommodates a ball at the front end of a pipe made of metal is force fitted into a 15 holder made of a synthetic resin. (For example, U.S. Pat. No. 4,311,403).

However, the ballpoint pen is usually used while inclined with respect to a writing surface. Therefore, a bending moment is applied to the front pipe portion at all times. When a large writing pressure (more specifically, a vertical load of about 1.0 kg or more with respect to the writing surface at a writing angle of 60 to 75°) is applied to the ballpoint pen tip in the conventional ballpoint pen, the writing pressure, of course, varying from one user to another, the front pipe portion is bent at the joint thereof. Particularly, in a pipe type ballpoint pen having a ball receiving seat formed by utilizing deformation of a metallic material by pressing, it is not practical to improve bending strength by increasing the thickness of the front pipe portion since it is difficult to manufacture a ballpoint pen having a very large thickness of the front pipe portion.

Further, the conventional ballpoint pen is usually such that the outer diameter of the front pipe portion and the outer diameter of the ball accommodated at the front end thereof are large (more specifically, the outer diameter of the front pipe portion is set to 0.8 mm or more and the outer diameter of the ball at the front end is set to 0.5 mm or more), which produces thick handwritten characters, thus making the ballpoint pen unsuitable for jotting down thin characters into small spaces in a pocketbook or the like. If the outer diameter of the front pipe portion and that of the ball at the front end are reduced in order to obtain a ballpoint pen suitable for producing thin handwritten characters, chances of the front pipe portion being bent with even a slight writing pressure increase.

If the front pipe portion has a thin wall thickness by having a ball receiving seat formed by inward deformation thereof (more specifically, the thickness of the front pipe portion is set to 0.15 mm or less), or if the front pipe portion has a small diameter to obtain a ballpoint pen tip dedicated to writing thin characters (more specifically, the outer diameter of the front pipe portion is set to 0.75 mm or less), or if the front pipe portion is hollow to allow ink to flow therethrough directly while having no ink inducing member therein, then the front pipe portion shakes with additional flexion of the pipe itself at the time of writing, which not only gives a sense of unstable writing to the user, but also increases the possibility of the front pipe portion being bent.

In the conventional ballpoint pen, the fixing strength between the holder and the pipe tends to be reduced due to secular change or the like if the holder is made of a synthetic resin. This causes the pipe greatly to shake at the time of writing, thereby giving the user a sense of unstable writing. Additionally, in the case of the holder made of a synthetic resin, large writing pressure and falling impact onto the floor applied to the ballpoint pen tip would cause the ballpoint pen tip to be pushed rearward and thereby be collapsed into the holder by an excessive force, which increases the likelihood of the user not being able to write with the ballpoint pen.

Still further, Japanese Unexamined Utility Model Publication No. 62-5978 and Japanese Examined Utility Model Publication No. 2-5994 disclose ballpoint pens in which a seal member made of an elastic member is arranged within a cap to seal the ballpoint pen tip of the ballpoint pen.

However, when the outer diameter of the front pipe portion and that of the ball at the front end are reduced in order to obtain a ballpoint pen suitable for writing thin characters, the seal member disclosed in the aforementioned Japanese Unexamined Utility Model Publication No. 62-5978 has recess portions so thin that the recess is broken due to excessive stress concentration caused by repeated abutment of the sharp ballpoint pen tip of the ballpoint pen thereagainst.

In addition, the seal member disclosed in Japanese Examined Utility Model Publication No. 2-5994 is of such a construction that almost all deformation of the ballpoint pen tip of the ballpoint pen due to the abutment is accommodated by the thin joining portion thereof. In addition, the joining portion of this seal member is short in the axial direction, and instantly produces resiliency due to tension upon abutment of the ballpoint pen tip against the recess. As a result of this construction, if the length of movement of the joining portion after the abutment of the ballpoint pen tip against the recess (the amount of pushing) is increased due to variations in the radial direction or in order to ensure sufficient sealing of the ballpoint pen tip, strong resiliency is applied to bias the ballpoint pen tip. Hence, when the outer diameter of the front pipe portion and that of the ball at the front are similarly reduced in order to obtain a ballpoint pen suitable for writing thin characters, there exists the possibility of the ballpoint pen tip sticking into the recess.

In other words, the conventional seal member is not sufficiently given consideration to the possibility of the seal member which is broken or stuck by the front pipe portion, since the outer diameter of the front pipe portion of the ballpoint pen is comparatively large (0.8 mm or more). That is, a seal member optimal for a ballpoint pen tip whose front pipe portion has such a small diameter as to allow thin characters to be written has not yet been disclosed.

SUMMARY OF THE INVENTION

The present invention has been made to overcome the aforementioned conventional problems. Accordingly, an object of the invention is to provide a ballpoint pen optimal for writing thin characters which does not cause the ballpoint pen tip to be bent by the writing pressure at the time of writing nor gives a user a sense of unstable writing due to the ballpoint pen tip shaking at the time of writing, and which does not allow the ballpoint pen tip to be collapsed into the holder. Another object of the invention is to provide a ballpoint pen having a cap with a seal member optimal for such a ballpoint pen tip dedicated to writing thin characters.

The present invention is directed to a ballpoint pen having a ballpoint pen tip at the front end thereof, the ballpoint pen tip rotatably accommodating a ball at the front end of a pipe made of metal, and requires that an outwardly projecting pipe portion having a uniform thickness throughout be arranged at the front end of the ballpoint pen tip, and that if the length of the pipe portion is L and the outer diameter of the pipe portion is D, a first relational expression $L/D \leqq 4.0$ be satisfied.

A ballpoint pen of the present invention comprises an ink reservoir tube for reservoiring an ink therein; a holding member being fitted to the ink reservoir tube; and a ballpoint pen tip having a pipe made of metal, which is held by the holding member, the pipe rotatably accommodating a ball at a front end thereof, the pipe including a pipe projecting portion which is projected from an end of the holding member; wherein the pipe projecting portion satisfies a first relational expression of $L/D \leqq 4.0$, where L is a length of the pipe projecting portion and D is an outer diameter of the pipe projecting portion.

When the first relational expression ($L/D \leqq 4.0$) is satisfied, bending and shaking of the pipe portion at the time of writing can be prevented.

In the first relational expression ($L/D \leqq 4.0$), the pipe portion is more susceptible to bending with increasing length L and with decreasing outer diameter D. That is, a value (L/D) represents the degree of susceptibility to bending; the smaller the value (L/D) is, the less susceptible to bending (and therefore more reliable the function of) the pipe portion becomes. The inventors have found that bending caused by a normal writing pressure can be sufficiently prevented when the value (L/D) is 4.0 or less. Particularly, when the outer diameter D of the pipe portion is set to 0.6 mm or less ($D \leqq 0.6$ mm), it is preferred that the value (L/D) be 2.5 or less ($L/D \leqq 2.5$). If the outer diameter D is set to 0.7 mm or less ($D < 0.7$ mm), it is preferred that the value (L/D) is 3.5 or less ($L/D \leqq 3.5$). Further, the value (L/D) is required to be a value larger than 0 ($L/D > 0$). However, since it is advantageous at least to project outwardly the front end edge portion 23 (usually tapered) of the pipe portion 3 in obtaining smooth writing performance, the value (L/D) is preferably 0.05 or more ($L/D \geqq 0.05$), or more preferably 0.1 or more ($L/D \geqq 0.1$).

In the aforementioned ballpoint pen, if the thickness of the pipe portion 3 is T, it is required that a second relational expression of $L/TD^2 \leqq 80$ is satisfied.

When both the first relational expression ($L/D \leqq 4.0$) and the second relational expression ($L/TD^2 \leqq 80$) are satisfied, bending and shaking of the pipe portion at the time of writing can more reliably be prevented.

In the second relational expression ($L/TD^2 \leqq 80$), the pipe portion is more susceptible to bending with increasing length and with decreasing thickness T and squared outer diameter D. That is, a value ($L/TD^2$) represents the degree of susceptibility to bending. This degree of susceptibility to bending is proportional to the length L and inversely proportional to the thickness T and $D^2$. The smaller the value ($L/TD^2$) is, the less susceptible to bending (and therefore more reliable the function of) the pipe portion becomes. The inventors have found that the pipe portion is not bent even by a large writing pressure if the value ($L/TD^2$) is 80 or less ($L/TD^2 \leqq 80$), and that the pipe portion is easily bent by a large writing pressure if the value ($L/TD^2$) is larger than 80 ($L/TD^2 > 80$). Of course, the length L of the pipe portion is larger than 0 ($L > 0$). However, to project the front end edge portion including the ball of the pipe portion outward in order to obtain smooth writing performance free from interference with a writing surface, the length L is effective when set to 0.01 mm or more ($L \geqq 0.01$ mm). Therefore, the value ($L/TD^2$) is 0.4 or more ($L/TD^2 \geqq 0.4$), or more preferably 1 or more ($L/TD^2 \geqq 1$). Further, to improve bending strength, it is preferred that the value ($L/TD^2$) be 60 or less ($L/TD^2 \leqq 60$). Still further, to reliably prevent bending against impact other than writing pressure, such as impact derived from falling, it is preferred that the value ($L/TD^2$) be 50 or less ($L/TD^2 \leqq 50$).

It should be noted that the respective dimensions, the length L, the outer diameter D, and the thickness T, of the pipe portion in the present invention are indicated in millimeters (mm). Further, the length L of the pipe portion does not include the exposed portion of the ball 22.

Still further, in the aforementioned ballpoint pen, it is effective that: the outer diameter D of the pipe portion 3 is set to 0.75 mm or less; the thickness T of the pipe portion is set to 0.15 mm or less (preferably to 0.13 mm or less); and the outer diameter of the ball is set to 0.45 mm or less. In addition, the aforementioned ballpoint pen preferably is designed so that the ballpoint pen tip rotatably accommodates the ball by a front end edge portion formed by inwardly deforming the front end of the metal pipe by pressing and by a ball receiving seat (a plurality of accommodating projections) formed by inwardly deforming the vicinity of the front end of the pipe by pressing.

If the outer diameter D of the pipe portion is small (more specifically, $D \leqq 0.75$ mm); the thickness T of the pipe portion is small ($T \leqq 0.15$ mm); or the outer diameter of the ball is set to 0.45 mm of less with the first and second relational expressions satisfied, then the pipe portion is sufficiently rigid against writing pressure, so that a pipe type ballpoint pen optimal for writing thin characters, and free from bending and shaking, can be obtained.

BRIEF DESCRIPTION OF THE DRAWINGS

In the accompanying drawings.

DETAILED DESCRIPTION OF THE PREFERRED EMBODIMENTS

The preferred embodiments of the present invention will be described with reference to the accompanying drawings.

Figure 1:
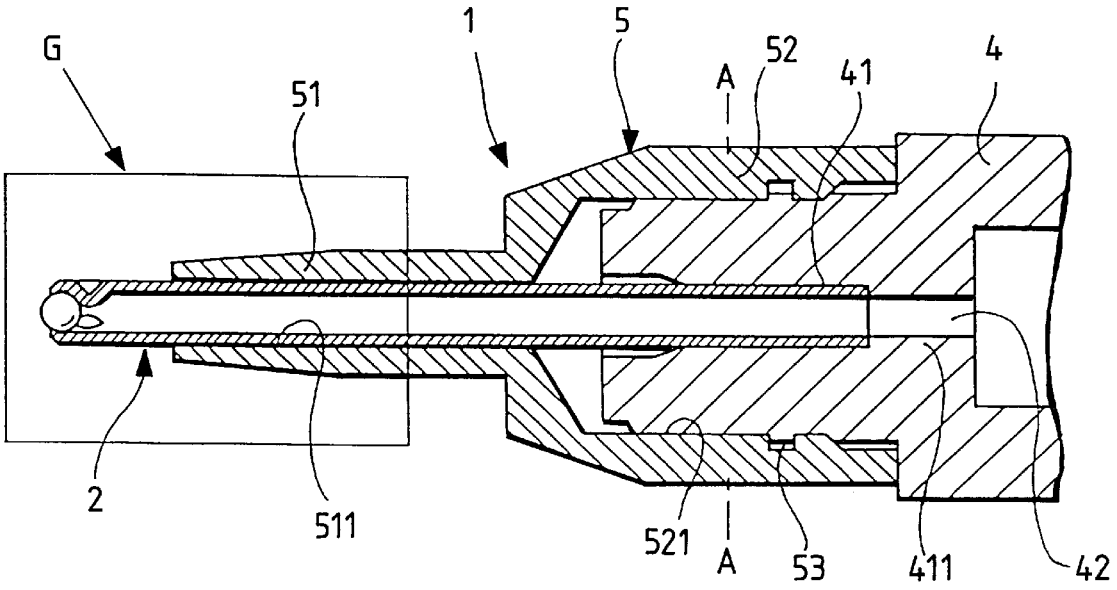
FIG. 1 is a longitudinal sectional view showing a main portion of a first embodiment of the invention.
Figure 2:
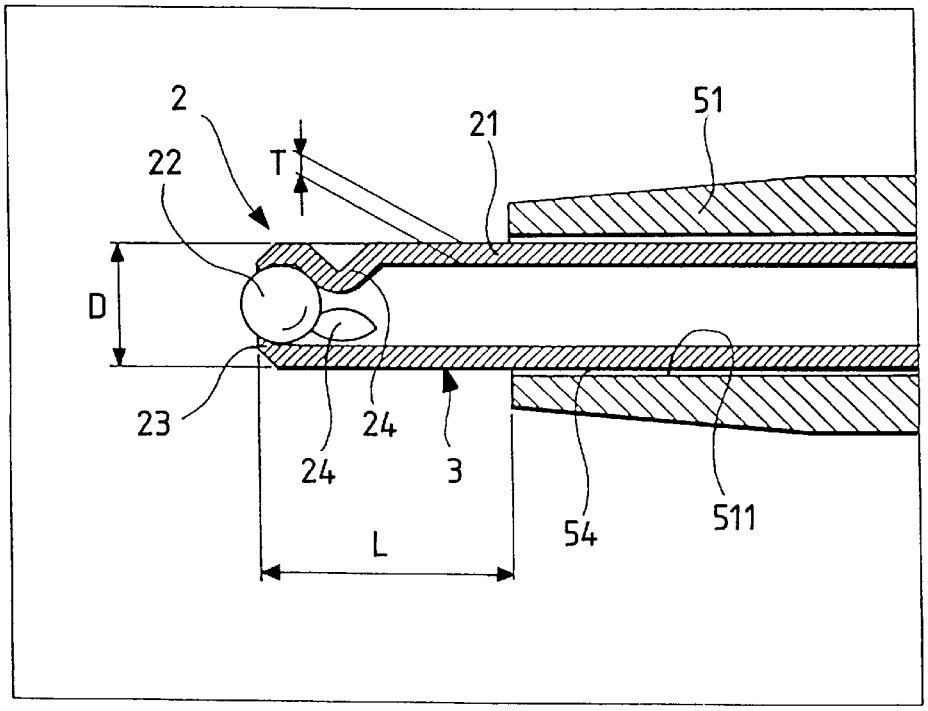
FIG. 2 is an enlarged view of the portion G of FIG. 1.
Figure 3:
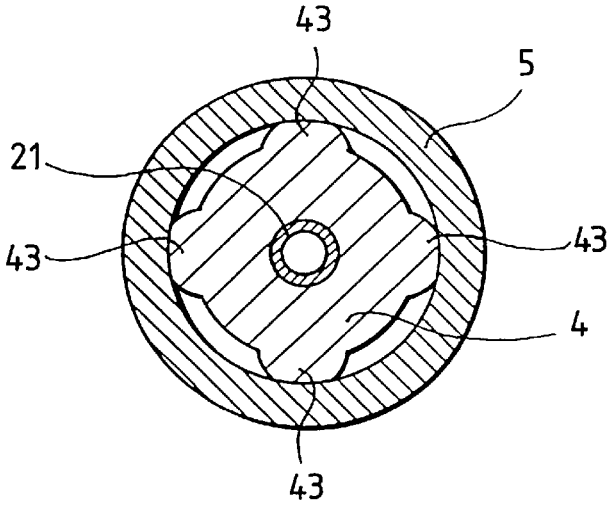
FIG. 3 is a sectional view taken along a line A—A in FIG. 1.

FIGS. 1, 2, and 3 show a first embodiment.

As shown in FIGS. 1 and 2, a ballpoint pen tip 2 is formed of a pipe 21 that is made of a stainless steel (more specifically, SUS304). The ballpoint pen tip 2 is made of a stainless steel, or preferably of an austenitic stainless steel (e.g., a grade, SUS304, according to the Japanese Industrial Standard). A ball receiving seat 24 (more specifically, three inwardly projecting portions) is formed in the vicinity of the front end of the pipe 21 by deforming the outer circumferential surface of such pipe portion inwardly by pressing equidistantly at three positions (or four positions). A ball 22 (made of a superalloy and having an outer diameter of 0.3 mm) is inserted in the front of the ball receiving seat 24, so that the ball 22 is rotatably accommodated at the front end of the pipe 21 by a front end edge portion 23 formed by inwardly deforming the front end of the pipe 21 by pressing.

A mounting hole 41 is provided in the front of a holder 4 made of a synthetic resin (e.g., polypropylene resin). The mounting hole 41 allows the ballpoint pen tip 2 to be fixed thereto by force fit. The mounting hole 41 has an inner diameter slightly smaller than the outer diameter of the ballpoint pen tip 2, and has a retaining wall portion 411 formed integrally therewith on the rear end thereof. The retaining wall portion 411 allows the rear end of the ballpoint pen tip 2 to be abutted thereagainst. A communication hole 42 runs through the retaining wall portion 411, which communicates the rear portion of the holder 4 with the mounting hole 41. The communication hole 42 has substantially the same inner diameter as the pipe 21. Since the holder 4 is made of the resin, the ballpoint pen tip 2 made of metal can be force-fitted into the mounting hole 41 because the mounting hole 41 has the inner diameter slightly smaller than the outer diameter of the ballpoint pen tip 2.

A support tube 5 for supporting the outer circumferential surface of the ballpoint pen tip 2 is fixed by force fit to the outer circumferential surface of the front portion of the holder 4. The support tube 5 is made of brass and has a nickel plating over the surface thereof. A tubelike small diameter portion 51 and a large diameter portion 52 are formed integrally with the support tube 5. The small diameter portion 51 has a hole 511 whose inner diameter is slightly larger than the outer diameter of the ballpoint pen tip 2. The large diameter portion 52 has a hole 521 into which the outer circumferential surface of the holder 4 is force-fitted.

The ballpoint pen tip 2 runs through the hole 511 of the small diameter portion 51. The small diameter portion 51 encloses the outer circumferential surface of the ballpoint pen tip 2 so as to support the ballpoint pen tip 2 in the radial direction.

A gap 54 exists between the outer circumferential surface of the ballpoint pen tip 2 and the hole 511 of the small diameter portion 51. The gap 54 (more correctly, the difference between the inner diameter of the hole 511 and the outer diameter of the pipe 21) is so small as ranging from 0.01 to 0.1 mm that shaking of the ballpoint pen tip 2 at the time of writing is extremely small, thereby not giving the user a sense of unstable writing. Further, the presence of the gap 54 facilitates assembly of the ballpoint pen tip 2 and the support tube 5 to the holder 4.

An annular groove 53 provided on the inner circumferential surface of the hole 521 of the large diameter portion 52. When the front portion of the holder 4 is force-fitted into the hole 521, the annular groove 53 is fitted with a plurality of ridges 43 (more specifically, four ridges) so as to bite into them. The ridges 43 are formed on the outer circumferential surface of the front portion of the holder 4. Consequently, it is possible to strongly fix the holder 4 to the support tube 5 as not to be easily released.

The outer diameter D of the pipe 21 used for the ballpoint pen tip 2 of the present invention is set to 0.5 mm and the thickness T thereof, to 0.09 mm. The length L of the pipe portion 3 projecting outward from the front end of the support tube 5 is set to 1.0 mm. The length L, the outer diameter D, and the thickness T of the pipe portion 3 satisfy a first relational expression ($L/D \leqq 4.0$) and a second relational expression ($L/TD^2 \leqq 80$) simultaneously to prevent bending at the joint of the pipe portion 3 at the time of writing with the ballpoint pen.

Figure 4:
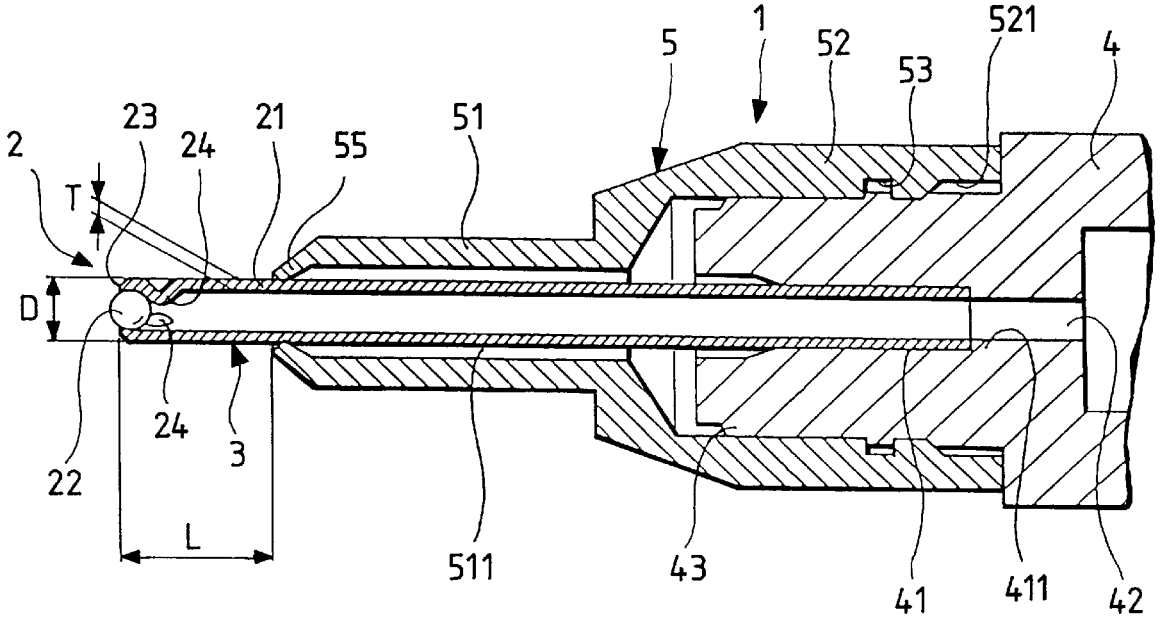
FIG. 4 is a longitudinal sectional view showing a main portion of a second embodiment of the invention.

FIG. 4 shows a second embodiment (a modification of first embodiment).

The outer circumferential surface of a ballpoint pen tip 2 is fixed by clamping by an inwardly deformed portion 55 which is formed by inwardly deforming the front end of a tubelike small diameter portion 51 of a support tube 5 by pressing. This construction allows the ballpoint pen tip 2 to be reliably supported in the radial direction and fixed in the axial direction, and therefore contributes to preventing the ballpoint pen tip 2 from bending and shaking, and at the same time to preventing the ballpoint pen tip 2 from being collapsed into the holder 4. The ballpoint pen tip 2 is fixed by clamping at a front position with respect to a mounting hole 41 of the holder 4, and it is with respect to such fixing and clamping position that the length L of a pipe portion 3 is set. As similar to the first embodiment, also in the second embodiment, the length L of the pipe portion 3 is set to 1.0 mm; the outer diameter D thereof, to 0.5 mm; and the thickness T thereof, to 0.09 mm. Other aspects of the construction of the second embodiment are similar to those of the first embodiment.

Figure 5:
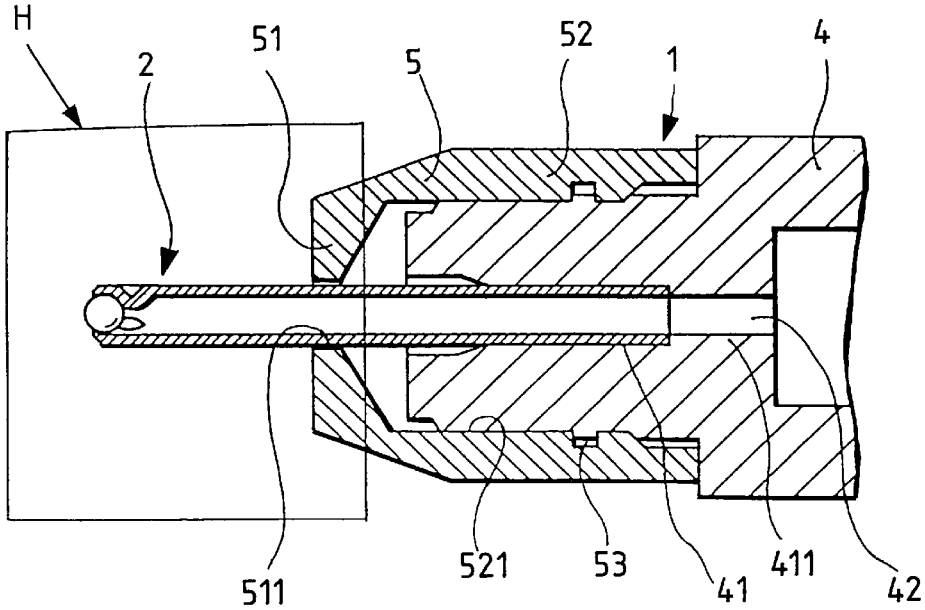
FIG. 5 is a longitudinal sectional view showing a main portion of a third embodiment of the invention.
Figure 6:
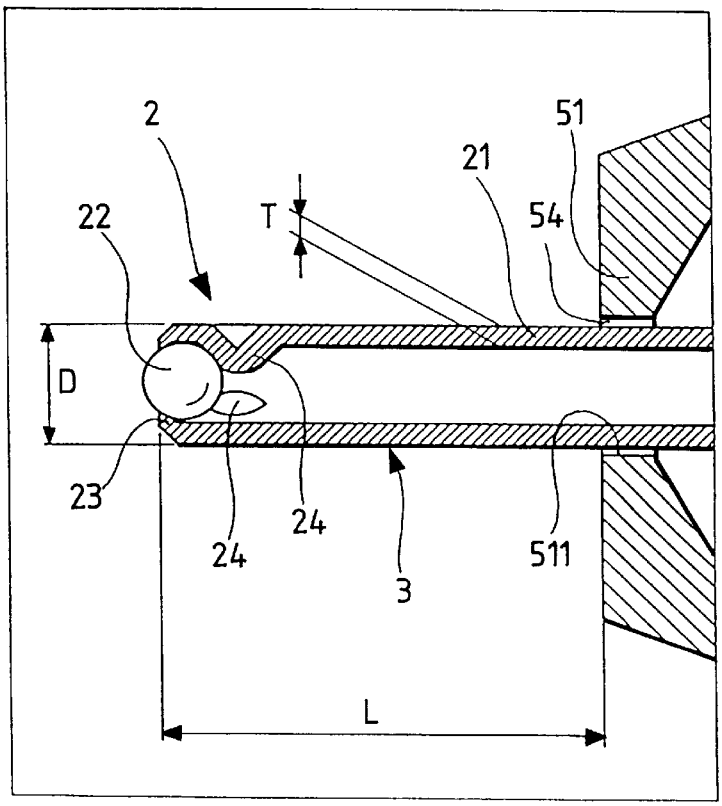
FIG. 6 is an enlarged view of the portion H of FIG. 5.

FIGS. 5 and 6 show a third embodiment.

The support tube 5 is made of brass by cutting. A support tube 5 has a small diameter portion 51 and a large diameter portion 52 formed integrally therewith. The small diameter portion 51 has a hole 511 whose inner diameter is larger than the outer diameter of a pipe 21 by about 0.01 to 0.1 mm. The large diameter portion 52 has a hole 521 into which the outer circumferential surface of the front portion of a holder 4 is force-fitted. A nickel plating is provided over the surface of the support tube 5.

As similar to first embodiment, in the structure for force-fitting the outer circumferential surface of the front portion of the holder 4 into the large diameter portion 52 of the support tube 5, an annular groove 53 on the inner circumferential surface of the hole 521 bites to engage with the outer circumferential surface of the front portion of the holder 4 made of a synthetic resin.

The small diameter portion 51 of the support tube 5 is located close to the front end of the holder 4, causing the front end of a ballpoint pen tip 2 to be exposed comparatively long. The outer circumferential surface of the ballpoint pen tip 2 is supported by the inner circumferential surface of the hole 511 at the time of writing.

The ballpoint pen tip 2 is formed of a stainless steel pipe 21 (whose outer diameter D is set to 0.65 mm and thickness T is 0.115 mm), and a ball 22 (made of a superalloy and having an outer diameter of 0.4 mm) is rotatably accommodated at the front end of the pipe 21 as in the first embodiment. The ballpoint pen tip 2 is fixed to the mounting hole 41 of the holder 4 made of the synthetic resin by force fit as in the first embodiment.

The length L of the pipe portion 3 is set to 2.0 mm. The length L, the outer diameter D, and the thickness T satisfy the first relational expression ($L/D \leqq 4.0$) and the second relational expression ($L/TD^2 \leqq 80$) simultaneously, and therefore provide effects similar to those of the first and second embodiments.

Figure 7:
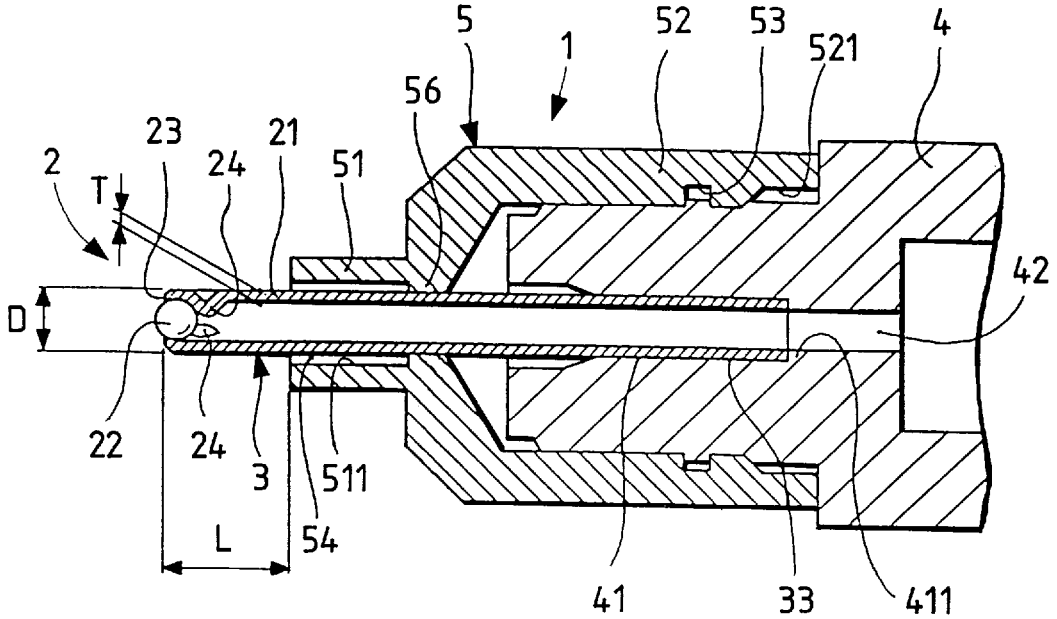
FIG. 7 is a longitudinal sectional view showing a main portion of a fourth embodiment of the invention.

FIG. 7 shows a fourth embodiment (a modification of third embodiment).

An inward projection 56 is arranged inside a hole 511 of a small diameter portion 51 of a support tube 5. The outer circumferential surface of a ballpoint pen tip 2 is fixed to the inward projection 56 by force fit. Further, a gap 54 is provided between an inner circumferential surface of the hole 511 and the corresponding outer circumferential surface of the ballpoint pen tip 2 as not to affect stability of the ballpoint pen tip 2 at the time of writing (more specifically, a gap ranging from 0.01 to 0.1 mm). The inner circumferential surface is located at a front position with respect to the inward projection 56. As a result of this construction, the ballpoint pen tip 2 can be fixed in the axial direction and supported in the radial direction reliably, which in turn prevents the ballpoint pen tip 2 from being collapsed into the holder 4, and at the same time from bending and shaking.

The ballpoint pen tip 2 projects from the front end of the small diameter portion 51 of the support tube 5 to form a pipe portion 3 as similar to the third embodiment. The length L of the pipe portion 3 is set to 1.5 mm. Other aspects of the construction of the fourth embodiment are similar to those of the third embodiment.

Figure 8:
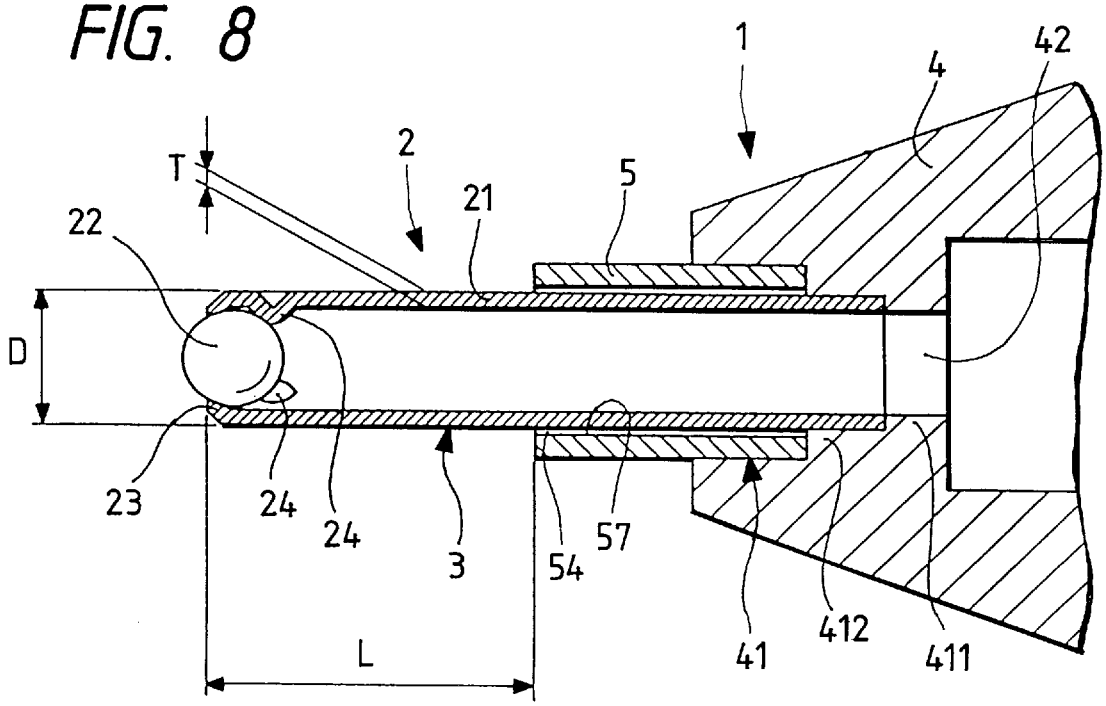
FIG. 8 is a longitudinal sectional view showing a main portion of a fifth embodiment of the invention.

FIG. 8 shows a fifth embodiment.

A support tube 5 is a cylindrical member having a uniform diameter throughout the length thereof and made of metal (e.g., a stainless steel), and is fixed by force fit to the front portion of a mounting hole 41 of a holder 4 made of a synthetic resin (e.g., a polyacetal resin). On the other hand, a ballpoint pen tip 2 (whose outer diameter D is 0.55 mm; thickness T is 0.09 mm; and the diameter of the ball 22 is 0.35 mm) is fixed to the rear portion of the mounting hole 41 of the holder 4 by force fit.

The mounting hole 41 of the holder 4 has an inner circumferential surface having an inner diameter as to allow the rear portion of the support tube 5 to be force-fitted thereinto at the front portion thereof, but also the other inner circumferential surface having the other inner diameter as to allow the rear portion of the ballpoint pen tip 2 to be force-fitted thereinto at the rear portion thereof. Further, retaining wall portions 412, 411 allowing the rear end of the support tube 5 and the ballpoint pen tip 2 to be abutted thereagainst are provided on the inner circumferential surface of the mounting hole 41, respectively.

The support tube 5 whose inner diameter is 0.6 mm supports the outer circumferential surface of the ballpoint pen tip 2 at the time of writing. The support tube 5 sets the length L (1.2 mm) of the pipe portion 3 to satisfy the first relational expression ($L/D \leqq 4.0$) and the second relational expression ($L/TD^2 \leqq 80$) simultaneously.

Figure 9:
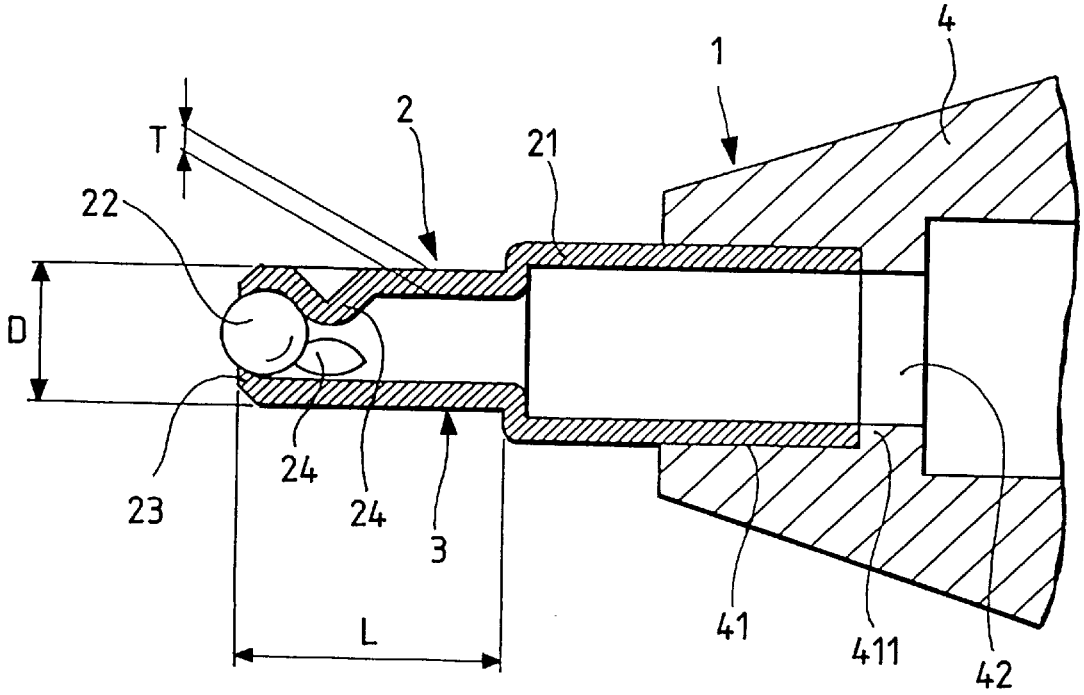
FIG. 9 is a longitudinal sectional view showing a main portion of a sixth embodiment of the invention.

FIG. 9 shows a sixth embodiment.

A ballpoint pen tip 2 is formed of a pipe 21 made of metal (e.g., a stainless steel), which has a pipe portion 3 formed by reducing the diameter of the front portion of the ballpoint pen tip 2. A ball 22 is rotatably accommodated at the front end of the pipe portion 3 by a front end edge portion 23 and a ball receiving seat 24 as in the first embodiment. The front end edge portion 23 is formed by deforming the pipe 21 in the radial direction by pressing. The large diameter rear portion of the ballpoint pen tip 2 is fixed to a mounting hole 41 of a holder 4 made of a synthetic resin by force fit as in the first to fifth embodiments.

The sixth embodiment has no such support tube 5 as those of the first to fifth embodiments. However, the pipe portion 3 has an outer diameter D of 0.6 mm, a thickness T of 0.1 mm, and a length L of 1.0 mm, so that the dimensions L, D, and T satisfy the first relational expression ($L/D \leqq 4.0$) and the second relational expression ($L/TD^2 \leqq 80$) simultaneously. Therefore, the possibility of the ballpoint pen tip 2 bending at the time of writing can be sufficiently limited as in the first to fifth embodiments. Moreover, the ball 22 accommodated at the front end has an outer diameter of 0.38 mm.

Figure 10:
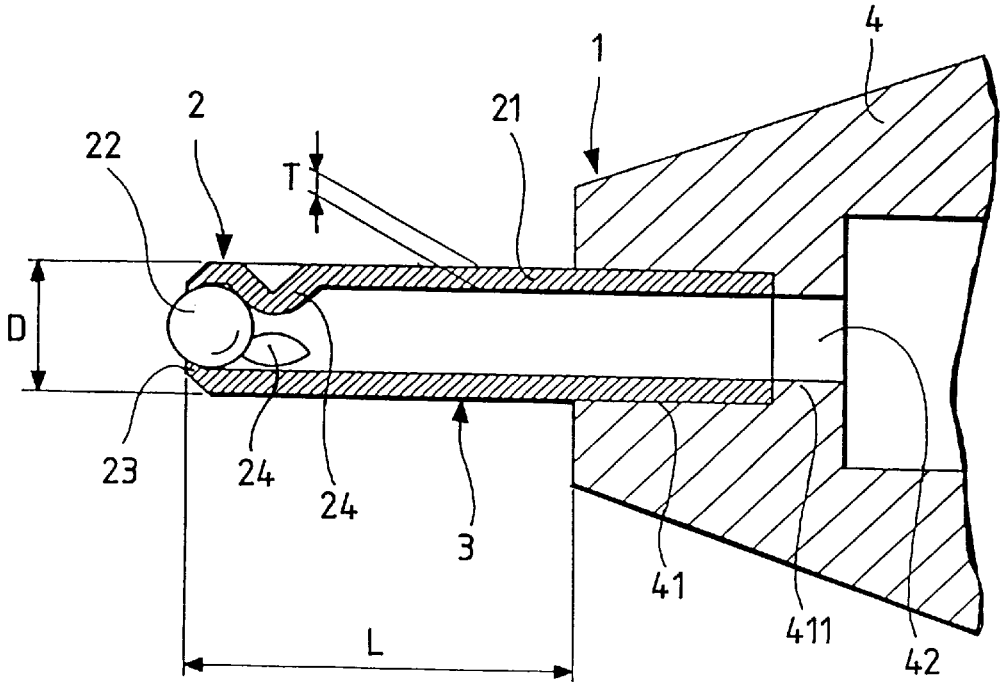
FIG. 10 is a longitudinal sectional view showing a main portion of a seventh embodiment of the invention.

FIG. 10 shows a seventh embodiment.

As in the first embodiment, a ballpoint pen tip 2 is formed of a metal pipe 21 having a uniform diameter throughout the length thereof. A ball 22 is rotatably accommodated by a front end edge portion 23 formed while deformed by pressing and by a ball receiving seat 24. The rear end of the ballpoint pen tip 2 is fixed to a mounting hole 41 of a holder 4 made of a synthetic resin (e.g., a polyacetal resin) by force fit. The front end of the ballpoint pen tip 2 is projected from the front end surface of the holder 4 to form a pipe portion 3 of the invention.

As similar to the sixth embodiment, the seventh embodiment has no such support tube 5 as those of the first to fifth embodiments. However, the outer diameter D of the pipe portion 3 is set to 0.7 mm; the thickness T thereof, to 0.14 mm; and the length L thereof, to 2.8 mm, and these dimensions L, D, and T also satisfy the first relational expression ($L/D \leqq 4.0$) and the second relational expression ($L/TD^2 \leqq 80$) simultaneously. Therefore, the possibility of the ballpoint pen tip 2 bending at the time of writing is sufficiently limited. In addition, the ball 22 accommodated at the front end has an outer diameter of 0.4 mm.

Figure 11:
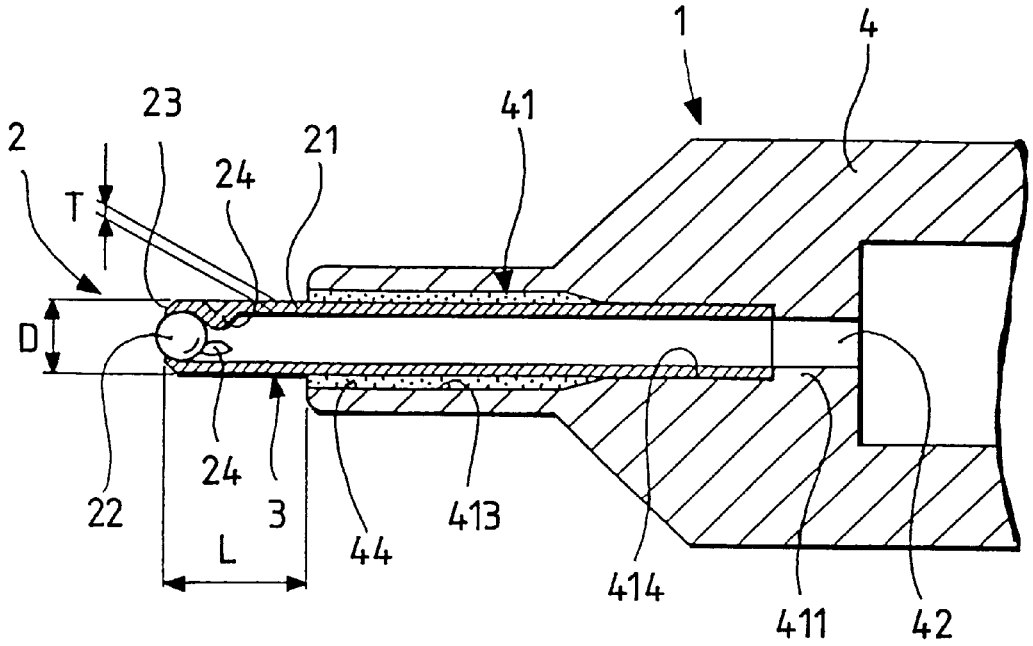
FIG. 11 is a longitudinal sectional view showing a main portion of an eighth embodiment of the invention.

FIG. 11 shows an eighth embodiment.

A mounting hole 41 is provided at the front end of a holder 4 made of metal (e.g., brass or stainless steel). A ballpoint pen tip 2 similar to that of the first embodiment is inserted into the mounting hole 41. The mounting hole 41 has a retaining wall portion 411 integrally formed with the holder 4. The retaining wall portion 411 allows the rear end of the ballpoint pen tip 2 to be abutted thereagainst. In addition, the mounting hole 41 has a hole 413 in the front thereof and a hole 414 in the rear thereof. The hole 413 has an inner diameter larger than the outer diameter of the ballpoint pen tip 2, and the hole 414 has an inner diameter that is substantially the same as the outer diameter of the ballpoint pen tip 2 and that allows the rear portion of the ballpoint pen tip 2 to be either force-fitted or loosely inserted thereinto. The hole 413 in the front is filled with an adhesive 44, not only allowing the ballpoint pen tip 2 to be rigidly fixed, but also preventing leakage of ink from the outer circumferential surface of the ballpoint pen tip 2. In addition, a communication hole 42 whose inner diameter is substantially the same as that of the ballpoint pen tip 2 is provided in the retaining wall portion 411 so as to pass through the retaining wall portion 411. As a result of this construction, the retaining wall portion 411 can provide a rigid portion against which the rear end of the pipe 21 is abutted, and at the same time ink flow is least blocked.

In the eighth embodiment, the length L of the pipe portion 3 is set to 0.9 mm; the outer diameter D thereof, to 0.5 mm; and the thickness T thereof, to 0.09 mm, and these dimensions L, D, and T satisfy the first relational expression ($L/D \leqq 4.0$) and the second relational expression ($L/TD^2 \leqq 80$). In addition, a ball 22 rotatably accommodated at the front end has an outer diameter of 0.3 mm.

Figure 12:
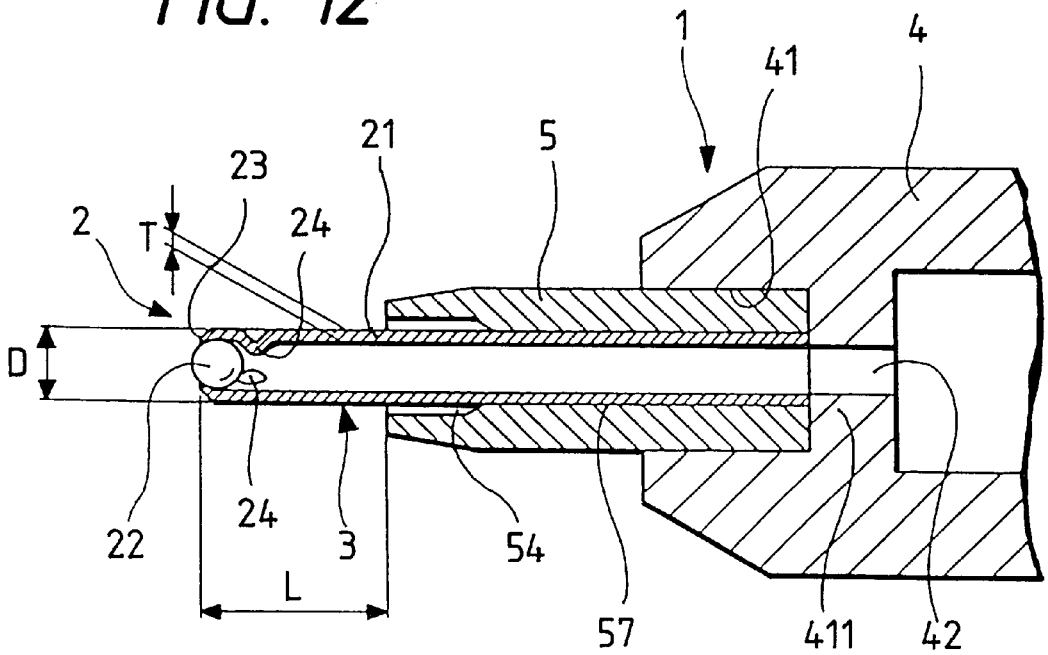
FIG. 12 is a longitudinal sectional view showing a main portion of a ninth embodiment of the invention.

FIG. 12 shows a ninth embodiment (a modification of eighth embodiment).

A cylindrical support tube 5 made of a synthetic resin (e.g., a polypropylene resin) is force-fitted into a mounting hole 41 of a holder 4 made of metal (e.g., brass). A ballpoint pen tip 2 similar to that of the first embodiment is force-fitted into an inner hole 57 of the support tube 5. That is, in the ninth embodiment, the ballpoint pen tip 2 and the holder 4 both made of metal are force-fitted into the holder 4 made of metal, respectively, (i.e., the structure utilizing the deformation of the synthetic resin) so that smooth force fitting operation can be implemented. As a result of this construction, the inner circumferential surface of the mounting hole 41 of the holder 4 and the outer circumferential surface of the ballpoint pen tip 2 are not damaged during the force-fitting, which in turn excludes the likelihood of ink being leaked.

Further, not only a retaining wall portion 411 located in the rear of the mounting hole 41 has a communication hole 42 whose inner diameter is substantially the same as that of the ballpoint pen tip 2, formed so as to run therethrough, but also the retaining wall portion 411 allows the rear end of the ballpoint pen tip 2 and the rear end of the support tube 5 to be abutted thereagainst. A rear portion of the inner hole 57 of the support tube 5 is formed so as to have an inner diameter slightly smaller than the outer diameter of the ballpoint pen tip 2, the rear portion extending in the axial direction thereof by an appropriate length, so that the ballpoint pen tip 2 can be force-fitted thereinto. In addition, in a front portion of the inner hole 57 of the support tube 5 exists a slight gap 54 with respect to the corresponding outer diameter of the pipe 21. The gap 54 (more correctly, the difference between the inner diameter of the inner hole 57 and the outer diameter of the ballpoint pen tip 2) is so small as ranging from about 0.01 to 0.1 mm that the ballpoint pen tip 2 rarely shakes. That is, the front portion of the inner hole 57 of the support tube 5 also supports the ballpoint pen tip 2 in the radial direction.

In the ninth embodiment, a ball 22 used has an outer diameter of 0.4 mm. The length L by which the ballpoint pen tip 2 projects from the support tube 5 is set to 1.9 mm; the outer diameter D of the ballpoint pen tip 2, to 0.65 mm; and the thickness T of the ballpoint pen tip 2, to 0.12 mm and satisfy the first relational expression ($L/D \leqq 4.0$) and the second relational expression ($L/TD^2 \leqq 80$).

Figure 13:
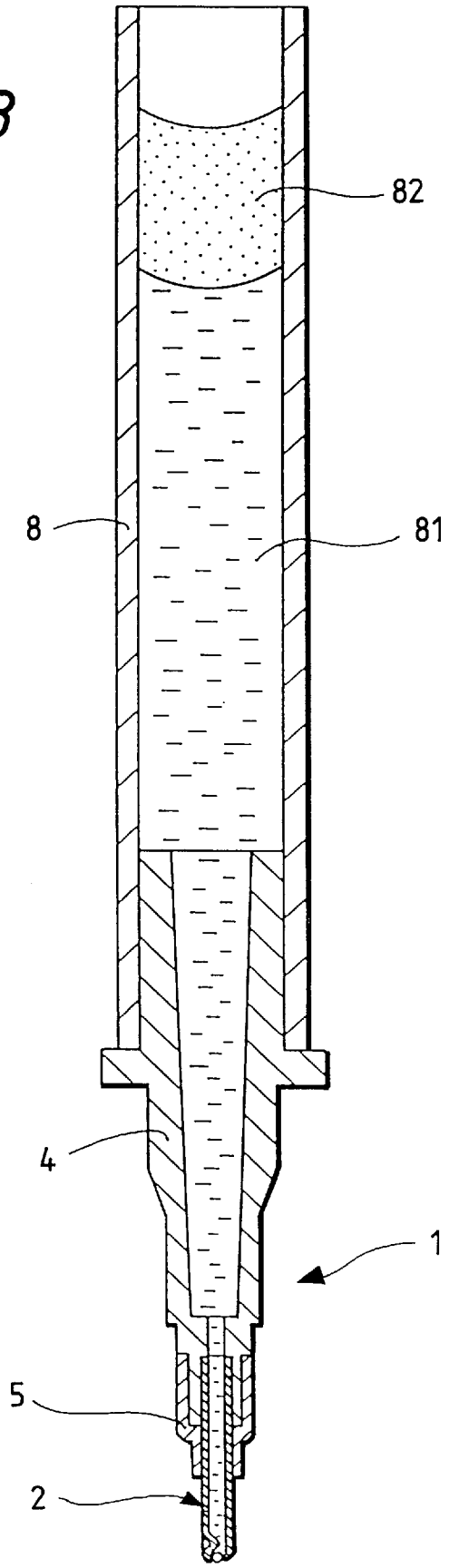
FIG. 13 is a longitudinal sectional view showing an example to which the invention is applied.

FIG. 13 shows an example to which the invention is applied.

This is an example in which the ballpoint pen 1 shown in the first to fourth embodiments is applied to a ballpoint pen refill. Both a ballpoint pen tip 2 and a support tube 5 are fixed to the front portion of a holder 4, and the rear portion of the holder 4 is fixed to the front opening of an ink reservoir tube 8 by force fit. The ink reservoir tube 8 is made of a transparent or translucent synthetic resin (such as polyethylene and polypropylene), and has therein an ink 81 and a check valve 82. The ink 81 has a shearing viscosity reducing property (more specifically, the viscosity of the ink 81 ranges from 10 to 150 mPa·s at a shearing speed of $384s^{-1}$ and at a temperature of 20° C.). The check valve 82 is located at the rear end of the ink 81 (e.g., implemented by a greasy reverse flow checking agent). Further, the ballpoint pen tip 2 is hollow so that the ink 81 flows directly into the ballpoint pen tip 2. There is no ink inducing agent or the like.

Figure 14:
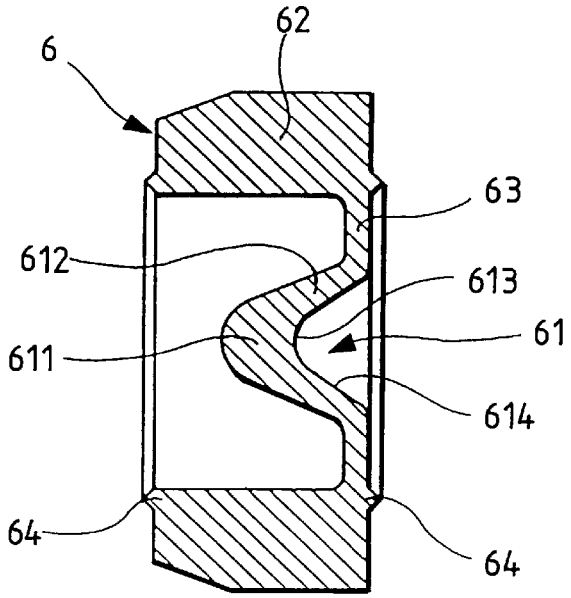
FIG. 14 is a longitudinal sectional view showing an embodiment of a seal member of the invention.
Figure 15:
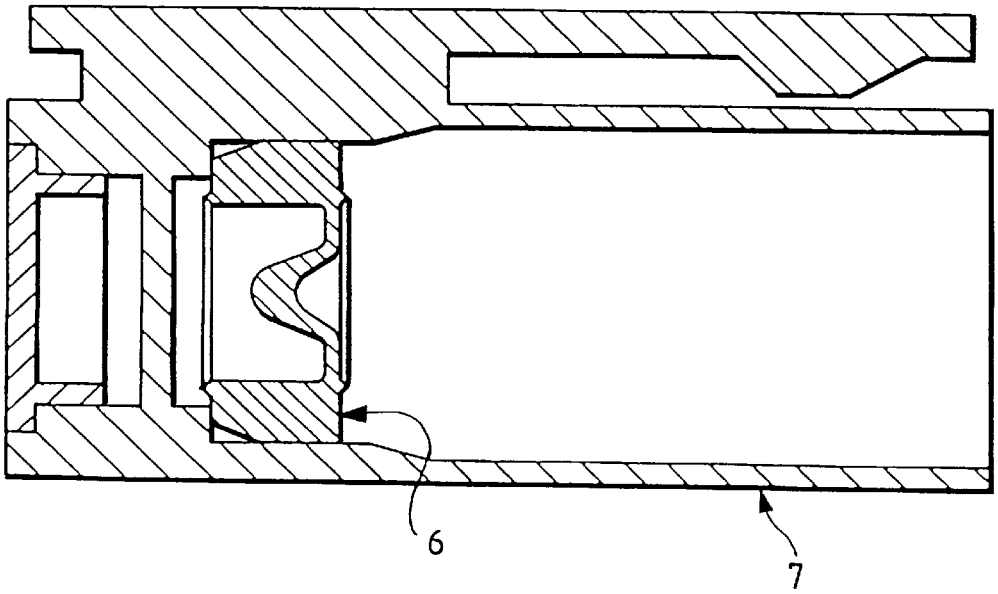
FIG. 15 is a longitudinal sectional view of a cap having the seal member shown in FIG. 14.
Figure 16:
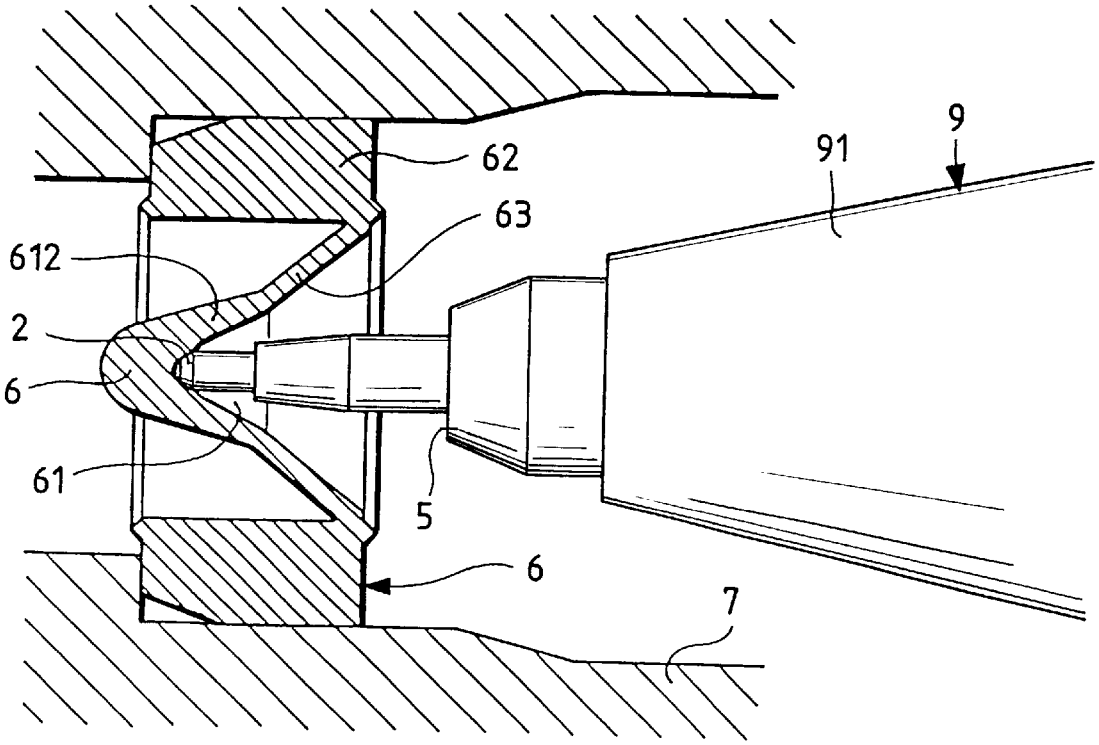
FIG. 16 is an enlarged view of a main portion illustrative of a mode of operation of the seal member shown in FIGS. 14 and 15.

FIGS. 14, 15, and 16 show an embodiment of a seal member 6 of the present invention.

The seal member 6 is formed of a tubelike portion 62 and a recess 61 that are joined integrally through a joining portion 63, and is fixed to a cap 7 by force fit. The recess 61 is disposed so as to be in the axis of the tubelike portion 62. In this embodiment ethylene-propylene rubber (EPDM) is used as a elastic member. The seal member 6 is made of a elastic material. More specifically, natural rubber or such synthetic rubber as silicone rubber, urethane rubber, ethylene-propylene rubber, styrene-butadiene rubber, or fluorine containing rubber is effective. In addition, to obtain smooth attachment to the cap 7, powdered lubricant (e.g., molybdenum disulfide, tetrafluoroethylene resin, or the like) is deposited on the surface thereof in a small amount.

The recess 61 is formed of a thick bottom wall 611 and a thin peripheral wall 612 to give the inner surface thereof a conical shape. The conical inner surface has a spherical surface portion 613 (with a radius is 0.5 mm) on the bottom thereof and a conically tapered portion 614 (at an angle of 70°) over the peripheral surface thereof. The spherical surface portion 613 has a diameter larger than the outer diameter of a ball 22 of a ballpoint pen tip 2. As a result of this construction, the exposed portion of the ball 22 at the front end of the ballpoint pen tip 2 can be enclosed entirely so as to prevent air compressed by the recess 61 and the ballpoint pen tip 2 from entering from the front end of the ballpoint pen tip 2 before the front end of the ballpoint pen tip 2 is sealed completely by the recess 61.

In addition, the peripheral wall 612 of the recess 61 is formed so that the thickness thereof goes on decreasing from the bottom wall 611 of the recess 61 (maximum thickness: 1.0 mm) to the peripheral edge portions thereof (minimum thickness: 0.3 mm). As a result of this construction, the portion that is to be largely stretched can be set to a position distant from the bottom wall 611 of the recess 61. Therefore, stress concentration at the bottom wall 611 of the recess 61 can be avoid to prevent breakage due to repeated stress. Moreover, since the joining portion 63 is joined to the rear end of the tubelike portion 62 and formed to be thin (to a thickness of 0.3 mm) as is the case with the peripheral wall 612 of the recess 61. Accordingly, resiliency applied to the ballpoint pen tip 2 can be further reduced by dispersing stress concentration borne by the bottom wall 61 of the recess 61, thereby preventing the recess 61 from being broken by the ballpoint pen tip 2 and the ballpoint pen tip 2 from sticking into the recess 61.

Furthermore, annular projections 64 are arranged on both end surfaces of the tubelike portion 62, preventing mutual adsorption of the seal member 6 that is in the collected condition where a plurality of seal members before being assembled to the cap are collected, for example, in a condition where the plurality of seal members are packed in a sack during being carried or kept, or stored in a parts feeder in assembling process.

In FIG. 16, a ballpoint pen main body 9 is attached to the cap 7 with the front end of the ballpoint pen tip 2 in contact with the seal member 6. The main body 9 has the aforementioned ballpoint pen refill accommodated therein. The ballpoint pen tip 2 and the support tube 5 are projected from the front end of a mouthpiece 91. When the ballpoint pen tip 2 is pushed frontward with the ballpoint pen tip 2 caused to be abutted against the bottom wall 611 of the recess 61, the joining portion 63 is largely stretched and, simultaneously therewith, the peripheral wall 612 of the recess 61 is not only slightly stretched, but also flexed in the radial direction at a reduced angle of the conically tapered portion 614. As a result, stress applied to the bottom wall 611 of the recess 61 is dispersed in portions thereabout, thereby allowing the front end of the ballpoint pen tip 2 to be sealed in the closely enclosed condition with a small pushing force. In addition, the peripheral wall 612 of the recess 61 wraps around the front end of the ballpoint pen tip 2 instantly before the exposed portion of the ball 22 at the front end of the ballpoint pen tip 2 is collapsed into the bottom wall 611 of the recess 61 completely, so that the front end of the ballpoint pen tip 2 can be reliably sealed with a soft touch despite the fact that the front end of the ballpoint pen tip 2 is collapsed into the bottom wall 611 of the recess 61 only slightly. As a result, breakage of the recess 61 by the ballpoint pen tip 2 and sticking into the recess 61 by the ballpoint pen tip 2 can be prevented.

In this embodiment, the ballpoint pen tip 2 accommodating the ball 22 whose outer diameter is set to 0.3 mm is applied to the front end of the pipe 21 made of stainless steel whose outer diameter is set to 0.5 mm. Despite the fact that the ballpoint pen tip of this embodiment is sharper than the conventional ballpoint pen tip 2 (the outer diameter of the ball 22 ranges from 0.5 to 1.0 mm and the outer diameter of the pipe 21 is about 2 mm), the sealability for the front end of the ballpoint pen tip 2 was not lost in the repeated operation of attaching the cap 7 (i.e., causing the ballpoint pen tip 2 to be abutted against the seal member 6) about several thousands of times, causing no breakage or sticking whatsoever.

Figure 17:
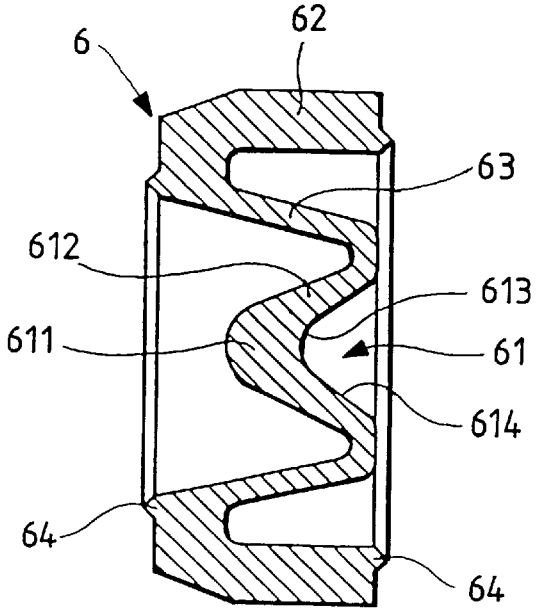
FIG. 17 is a longitudinal sectional view showing another embodiment of a seal member of the invention.

FIG. 17 shows another embodiment of the seal member 6 of the invention.

A joining portion 63 joining a recess 61 to a tubelike portion 62 is connected to the front end of the tubelike portion 62 so as to be extended toward the front of the recess 61. As a result of this construction, when the front end of the ballpoint pen tip 2 is abutted against the recess 61, the joining portion 63 is flexed in the radial direction by compressive force; i.e., the action of spring of the joining portion 63 can disperse stress applied to the recess 61, thereby allowing a mode of operation similar to that of the embodiment of FIG. 14 to be obtained. In addition, other aspects of the construction are similar to those of the embodiment of FIG. 14.

What is claimed is:

1. A ballpoint pen comprising:

a ballpoint pen tip provided at a top end portion of said ballpoint pen, said ballpoint pen tip including a metallic pipe which accommodates a ball at a front end and has a pipe projecting portion being projected outwardly;

wherein said pipe projecting portion satisfies a first relational expression of $L/D \leqq 4.0$, where L is a length of said pipe projecting portion and D is an outer diameter of said pipe projecting portion;

wherein D is $\leqq 0.75$ mm.

2. A ballpoint pen according to claim 1, wherein said projecting portion satisfies a second relational expression of $L/TD^2 \leqq 80$, where T is a thickness of said pipe projecting portion.

3. A ballpoint pen according to claim 2, wherein the thickness T of said pipe projecting portion is 0.15 mm or less.

4. A ballpoint pen according to claim 3, wherein an outer diameter of said ball is 0.45 mm or less.

5. A ballpoint pen according to claim 4, wherein said pipe has a front end edge portion formed by inwardly deforming the front end of said pipe and a plurality of ball receiving seats formed by inwardly deforming a vicinity of the front end of the pipe, so that said ballpoint pen tip rotatably accommodates said ball.

6. A ballpoint pen according to claim 5, further comprising a holding member made of synthetic resin, which includes a mounting hole at a front portion thereof for allowing said ballpoint pen tip to be fixed thereto and a retaining wall portion at a rear end thereof for allowing a rear end of said ballpoint pen tip to be abutted thereagainst.

7. A ballpoint pen according to claim 6, further comprising a support tube for supporting an outer circumferential surface of said ballpoint pen tip, said support tube being fixed to said holding member.

8. A ballpoint pen according to claim 7, wherein a gap exists between said support tube and the outer circumferential surface of said ballpoint pen tip along a portion for supporting the outer circumferential surface of said ballpoint pen tip, said gap ranging from 0.01 to 0.1 mm.

9. A ballpoint pen according to claim 8, wherein said gap is filled with an adhesive to fixing said support tube to the outer circumferential surface of said ballpoint pen tip.

10. A ballpoint pen according to claim 7, wherein said support tube made of metal includes a small diameter portion for supporting the outer circumferential surface of said ballpoint pen tip and a large diameter portion being fixed to an outer circumference of said holding member, said small diameter portion and said large diameter portion being formed integrally.

11. A ballpoint pen according to claim 6, wherein said ballpoint pen tip is fixed to said mounting hole of said holding member by force fit and a supporting tube made of a metal is fixed to said mounting hole by force fit, so that an inner circumferential surface of said support tube supports an outer circumferential surface of said ballpoint pen tip.

12. A ballpoint pen according to claim 5, further comprising a holding member made of metal, which includes a mounting hole at a front portion for allowing said ballpoint pen tip to be fixed thereto, and a retaining wall portion being integrally arranged at a rear end for allowing a rear end of said ballpoint pen tip to be abutted thereagainst.

13. A ballpoint pen according to claim 5, wherein said ballpoint pen tip including a reduced pipe portion which is formed by reducing a diameter of a front end of said ball point pen tip, and a rear portion of said ballpoint pen tip having a original diameter is fixed to said holder.

14. A ballpoint pen according to claim 5, further comprising a cap being releasable from a front end portion of said ballpoint pen, which has a seal member therein for sealing a front end of said ballpoint pen tip, said seal member being comprised of an elastic member including a recess portion having a conical inner surface for closely enclosing the front end of said ballpoint pen tip and a tubelike portion for disposing said recess portion in an axis thereof which are integrally formed, wherein a thickness of a bottom wall of said recess portion is larger than a thickness of a peripheral wall of said recess portion.

15. A ballpoint pen according to claim 14, wherein a thickness of a joining portion for joining said peripheral wall to the tubelike portion of said recess is equal to or smaller than the thickness of the peripheral wall of said recess 61.

16. A ballpoint pen according to claim 14, wherein a peripheral wall of said recess portion is formed so that a thickness of said peripheral wall goes on decreasing from a bottom wall of said recess to a peripheral edge portions thereof.

17. A ballpoint pen comprising:

an ink reservoir tube for reservoiring an ink therein;

a holding member being fitted to said ink reservoir tube; and a ballpoint pen tip comprising a metallic pipe held by said holding member, said pipe including a ball accommodating portion for rotatably accommodating a ball in a front end of said pipe and including a pipe projecting portion which is projected from an end of said holding member;

wherein said pipe projecting portion satisfies a first relational expression of $0.05 \leqq L/D \leqq 4.0$ and a second relational expression of $0.4 \leqq L/TD^2 \leqq 80$, where L is a length of said pipe projecting portion, D is an outer diameter of said pipe projecting portion and T is a thickness of said pipe projecting portion; and wherein D is $\leqq 0.75$ mm.

18. A ballpoint pen according to claim 17, wherein the thickness T of said pipe projecting portion is 0.15 mm or less.

19. A ballpoint pen according to claim 18, wherein an outer diameter of said ball is 0.45 mm or less.

20. A ballpoint pen according to claim 19, wherein said accommodating portion comprises a plurality of ball receiving seats formed in a vicinity of the front end of said pipe; and a front end edge portion which is formed by inwardly deforming the front end of said pipe by pressing.

21. A ballpoint pen according to claim 20, wherein said holding member including:

a mounting hole provided in a front of said holding member for allowing said ballpoint pen tip to be fixed thereinto by force fit;

a retaining wall portion formed integrally with said mounting hole, for allowing a rear end of said ballpoint pen tip to be abutted thereagainst; and a communication hole running through said retaining wall portion, which communicates the rear portion of said holding member, said communication hole having substantially the same inner diameter as said pipe.

22. A ballpoint pen according to claim 21, further comprising:

a support tube for supporting at least a part of an outer circumferential surface of said ballpoint pen tip, said support tube being fixed by force fit to an outer circumferential surface of the front portion of the holding member;

wherein said support tube includes a small diameter portion for allowing said ballpoint pen tip running through thereinto, said small diameter portion of said support tube having a first hole whose inner diameter is slightly larger than the outer diameter of said ballpoint pen tip; and a large diameter portion for enclosing the outer circumferential surface of the front portion of said holding member, said large diameter portion of said support tube having a second hole into which the outer circumferential surface of said holding member is force-fitted.

23. A ballpoint pen according to claim 22, wherein said support tube further comprises an inward projection for force-fitting to the outer circumferential surface of said ballpoint pen tip.

24. A ballpoint pen according to claim 23, wherein said inward projection is provided on a rear end portion of said first hole.

25. A ballpoint pen according to claim 22, wherein a gap exists between the outer circumferential surface of said ballpoint pen tip and said first hole, said gap being in the range from 0.01 mm to 0.1 mm.

26. A ballpoint pen according to claim 25, wherein said large diameter portion has an annular groove provided on an inner circumferential surface of said second hole, and said holding member has a plurality of ridges, so that said annular groove is fitted with said plurality of ridges to bite thereinto.

27. A ballpoint pen according to claim 21, further comprising a support tube for supporting at least a part of an outer circumferential surface of said ballpoint pen tip, which is fixed by force fit to an outer circumferential surface of the front portion of the holding member;

wherein said support tube includes a small diameter portion for allowing said ballpoint pen tip running through thereinto, which has an inwardly deformed portion for fixing and clamping the outer circumferential surface of said ballpoint pen tip; and a large diameter portion for enclosing the outer circumferential surface of the ballpoint pen tip, which has a second hole into which the outer circumferential surface of said holding member is force-fitted.

28. A ballpoint pen according to claim 21, wherein said ballpoint pen tip has reduced pipe portion at a front portion thereof.

29. A ballpoint pen according to claim 21, wherein said mounting hole includes a third hole and fourth hole, said third hole having an inner diameter larger than an outer diameter of said ballpoint pen tip so as to exist a gap filled with an adhesive between the inner diameter and an outer circumference of said ballpoint pen tip, said fourth hole having an inner diameter substantially the same as the outer diameter of said ballpoint pen tip to be force-fitted.

30. A ballpoint pen according to claim 20, further comprising a supporting tube for supporting said ball point pen tip wherein said holding member including:

a mounting hole provided in a front portion of said holding member, said mounting hole having a front portion to which said supporting tube is fitted by force fit and a rear portion to which said ballpoint pen tip is fixed by force fit;

a first retaining wall portion formed integrally with said mounting hole, for allowing a rear end of said ballpoint pen tip to be abutted thereagainst;

a second retaining wall portion formed integrally with said mounting hole, for allowing a rear end of said supporting tube to be abutted thereagainst; and a communication hole running through said retaining wall portion, which communicates the rear portion of said holding member, said communication hole having substantially the same inner diameter as said pipe.

31. A ballpoint pen according to claim 20, further comprising a supporting tube for supporting at least a part of an outer circumferential surface of said ballpoint pen tip;

wherein said holding member includes a mounting hole, a retaining wall portion and a communication hole running through said retaining wall portion, which communicates the rear portion of said holding member, said communication hole having substantially the same inner diameter as said pipe;

wherein said supporting member having a first inner circumferential portion at a rear portion, to which said ballpoint pen tip is force-fitted, and a second inner circumferential portion at a front portion which forms a gap between said ballpoint pen tip.

32. A ballpoint pen according to claim 20, further comprising a cap being releasable from a front end portion of said ballpoint pen, which has a seal member therein for sealing a front end of said ballpoint pen tip, said seal member being comprised of an elastic member including a recess portion having a conical inner surface for closely enclosing the front end of said ballpoint pen tip and a tubelike portion for disposing said recess portion in an axis thereof which are integrally formed to be joined through a joining portion.

33. A ballpoint pen according to claim 32, wherein said recess portion including a thick bottom wall and a thin peripheral wall which forms a conical inner surface having a conical shape on an inner surface of said recess portion, said conical inner surface having a spherical surface portion on a bottom of said conical inner surface and a conically tapered portion over a peripheral surface of said conical inner surface.

34. A ballpoint pen according to claim 33, wherein a thickness of a bottom wall of said recess portion is larger than a thickness of a peripheral wall of said recess portion.

35. A ballpoint pen according to claim 34, wherein said peripheral wall of said recess portion is formed so that the thickness of said peripheral wall goes on decreasing from said bottom wall to a peripheral edge portions thereof.

36. A ballpoint pen according to claim 17, wherein said pipe projecting portion satisfies a third relational expression of $0.1 \leqq L/D \leqq 3.5$.

37. A ballpoint pen according to claim 17, wherein said pipe projecting portion satisfies a fourth relational expression of $1 \leqq L/TD^2 \leqq 60$.

38. A ballpoint pen according to claim 37, wherein said pipe projecting portion satisfies a fourth relational expression of $1 \leqq L/TD^2 \leqq 50$.

* * * * *